US007095375B2

(12) United States Patent
Kfoury et al.

(10) Patent No.: US 7,095,375 B2
(45) Date of Patent: Aug. 22, 2006

(54) CLIPPED CONTACT WHIP AND FLEX ANTENNA ASSEMBLY FOR A DEVICE

(75) Inventors: Tony Kfoury, Lisle, IL (US); Jim Mathews, Mt. Prospect, IL (US)

(73) Assignee: Amphenol-T&M Antennas, Vernon Hills, IL (US)

( * ) Notice: Subject to any disclaimer, the term of this patent is extended or adjusted under 35 U.S.C. 154(b) by 0 days.

(21) Appl. No.: 11/120,259

(22) Filed: May 2, 2005

(65) Prior Publication Data

US 2005/0243015 A1 Nov. 3, 2005

Related U.S. Application Data

(60) Provisional application No. 60/566,861, filed on Apr. 30, 2004.

(51) Int. Cl.
*H01Q 1/24* (2006.01)

(52) U.S. Cl. ..... 343/702; 343/895; 343/906

(58) Field of Classification Search ..... 343/702, 343/895, 725, 729, 906; H01Q 1/24
See application file for complete search history.

(56) References Cited

U.S. PATENT DOCUMENTS 5,754,141 A * 5/1998 Thompson et al. ..... 343/702
6,034,639 A 3/2000 Rawlings et al.
6,992,642 B1 * 1/2006 Goldman et al. ..... 343/901
2005/0122275 A1 * 6/2005 Minoura et al. ..... 343/878
2005/0195113 A1 * 9/2005 Candal ..... 343/702

* cited by examiner

*Primary Examiner*—Hoanganh Le
(74) *Attorney, Agent, or Firm*—Greer, Burns & Crain, Ltd

(57) ABSTRACT

Antenna assembly for a portable device. The antenna assembly includes a nonconductive base, a conductive bushing held within a lower end of the base, and a flex antenna wrapped around the base. The flex antenna includes a trace having substantially all of its length disposed around an upper end of the base axially away from the conductive bushing and terminating in a flexible end contact that extends over the bushing. A conductive mechanism engages the conductive bushing and presses the flexible end contact against the bushing. The conductive mechanism includes an exposed elongated contact. A whip antenna extends through the nonconductive base, and includes a nonconductive extension extending from a top end thereof and a lower contact for electrically contacting the bushing when the whip antenna is extended relative to the base.

20 Claims, 18 Drawing Sheets

CLIPPED CONTACT WHIP AND FLEX ANTENNA ASSEMBLY FOR A DEVICE

PRIORITY CLAIM

The present application claims the benefit of U.S. Provisional Application No. 60/566,861, filed Apr. 30, 2004, under 35 U.S.C. § 119.

FIELD OF THE INVENTION

The present invention relates generally to the field of wireless communication for portable devices. The present invention relates more particularly to the field of antennas.

BACKGROUND OF THE INVENTION

It is desirable to enable reception of various radio-frequency bands in a single portable device such as, but not limited to, a wireless communication device or a portable computing device. One potential method of doing so is by using different antennas, each connected to circuitry of the device, respectively receiving one or more different frequency bands. For example, a flex antenna (that is, conductive traces in or on a flexible substrate) and elongated (e.g., whip) antenna may separately be integrated into a single device to allow reception of different frequencies.

However, it may be difficult to provide steady, reliable electrical contact between different antennas and the circuitry of a particular device. Further, it may be difficult to mechanically integrate multiple antennas into a device. Additionally, it may be a challenge to provide such integration while adhering to sometimes rigid volume and area considerations for an antenna assembly, as may be required by certain consumer or manufacturing demands, for example. Still further, such an antenna assembly should be suitable for repeatable or mass production with or separately from the device, while substantially maintaining quality of the antenna assembly.

SUMMARY OF THE INVENTION

Preferred embodiments of the present invention include an antenna assembly for a portable device. The antenna assembly includes a nonconductive base, a conductive bushing held within a lower end of the base, and a flex antenna wrapped around the base. The flex antenna includes a trace having substantially all of its length disposed around an upper end of the base axially away from the conductive bushing and terminating in a flexible end contact that extends over the bushing.

A conductive mechanism engages the conductive bushing and presses the flexible end contact against the bushing. The conductive mechanism includes an exposed elongated contact. A whip antenna extends through the nonconductive base, and includes a nonconductive extension extending from a top end thereof and a lower contact for electrically contacting the bushing when the whip antenna is extended relative to the base.

DETAILED DESCRIPTION OF PREFERRED EMBODIMENTS

Figure 1:
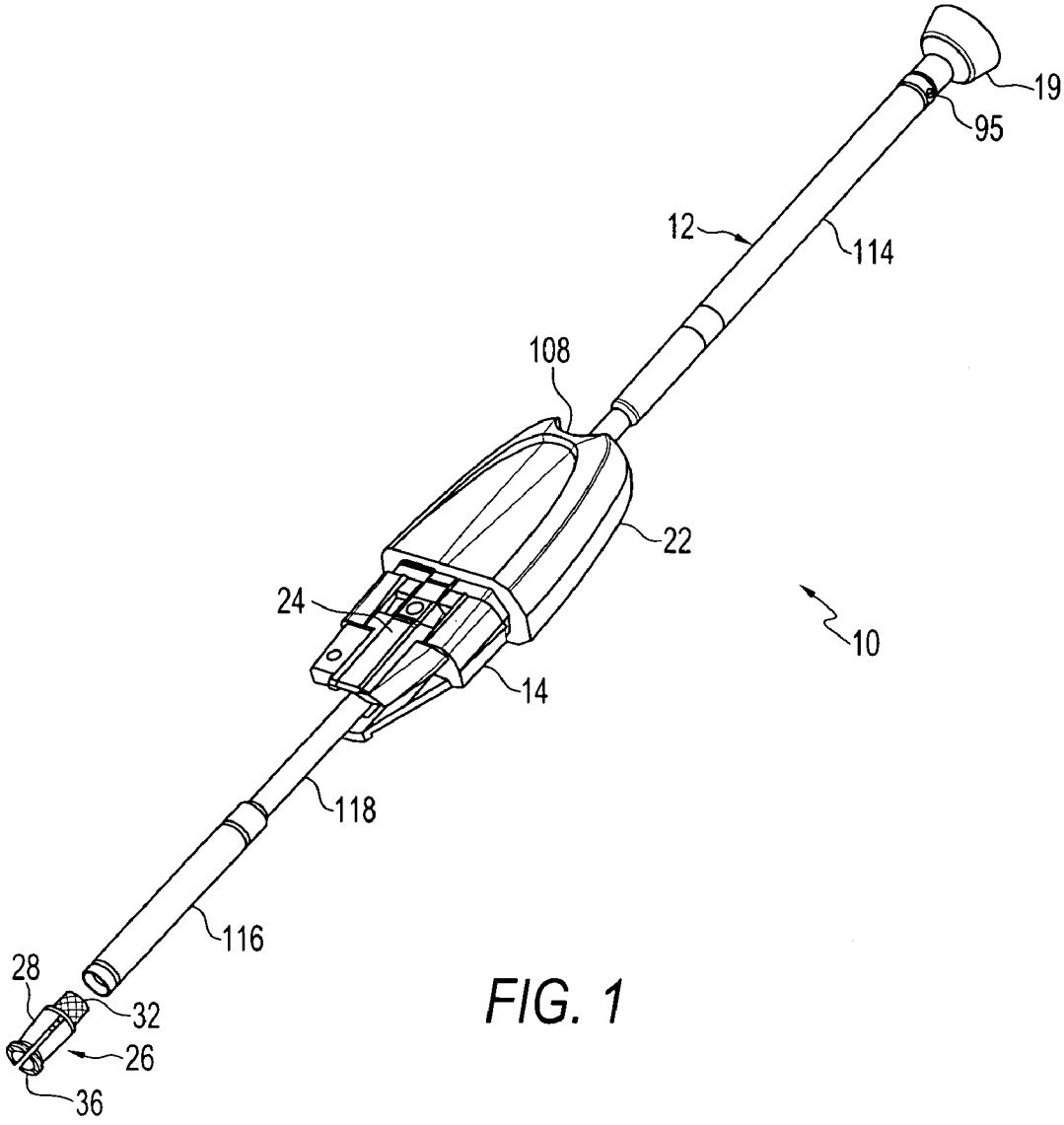
FIG. 1 is a perspective view of an antenna assembly according to a preferred embodiment of the present invention, having a whip antenna in a partially extended position, and a stop separated from the whip antenna.
Figure 2:
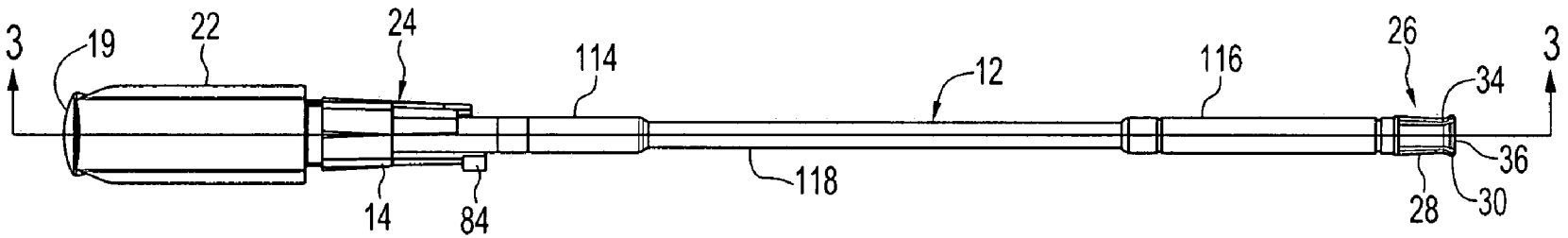
FIG. 2 is a side elevation view of the antenna assembly of FIG. 1 with the stop connected and the whip antenna in a retracted position.
Figure 3:
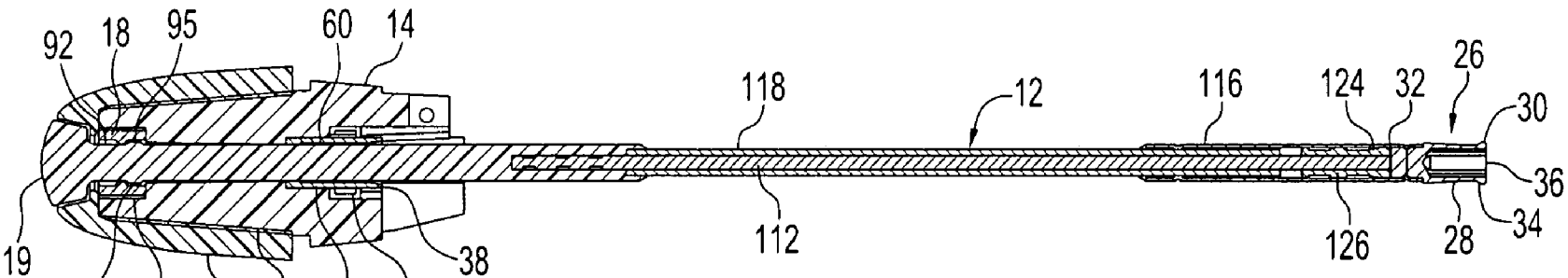
FIG. 3 is a sectional view of the antenna assembly of FIG. 2, taken along line 3—3 of FIG. 2 and in the direction indicated.
Figure 4:
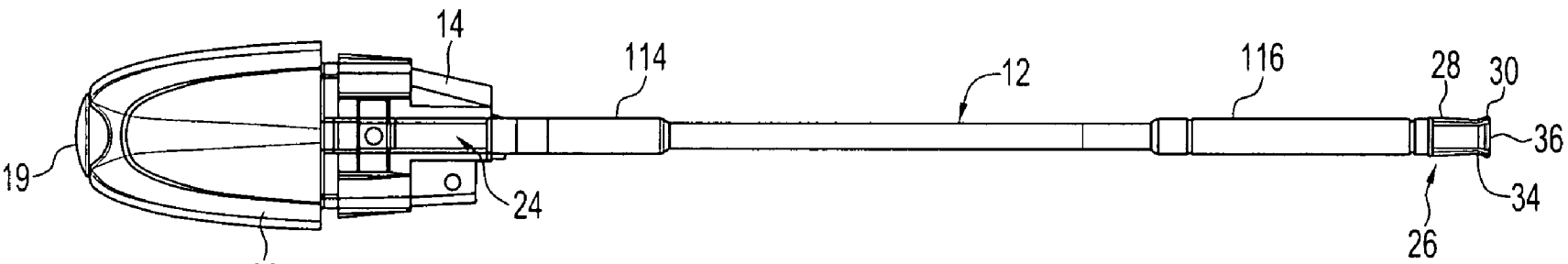
FIG. 4 is a top plan view of the antenna assembly of FIGS. 1–3 with the whip antenna retracted.
Figure 5:
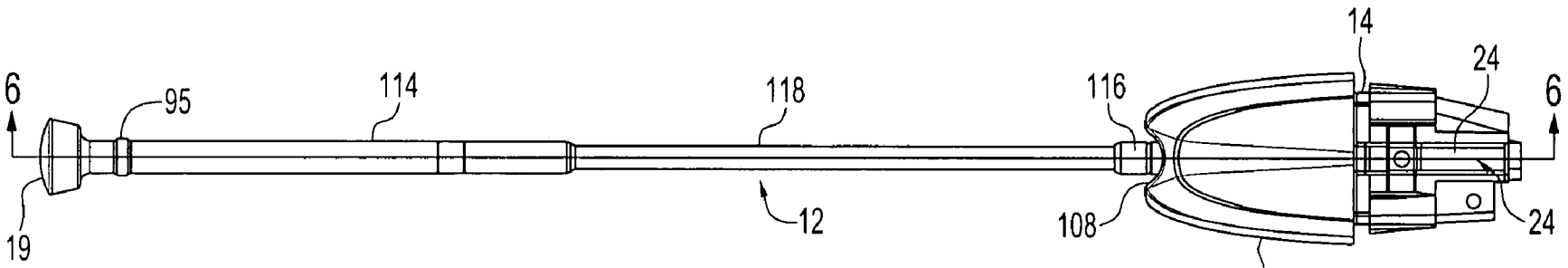
FIG. 5 is a top plan view of the antenna assembly of FIGS. 1–3, with the whip antenna fully extended.

To improve radio-frequency (RF) reception in a device by, for example, providing multiple antennas to receive signals at various frequencies, it is contemplated to provide an antenna assembly including both an elongated antenna, such as a whip antenna, and a flex antenna. However, it may be difficult to provide an antenna assembly that maintains secure electrical contact between the flex antenna and/or the elongated antenna and the circuitry of the device. Furthermore, it is advantageous to provide an antenna assembly and assembly method that allows repeatable or large-scale production at a reasonable cost.

A preferred embodiment of the present invention provides, among other things, an antenna assembly for a portable device which includes an elongated antenna such as a whip antenna, a flex antenna, and a conductive mechanism for coupling the whip antenna and the flex antenna to circuitry of the device. Preferably, the flex antenna is wrapped around a base, and includes an elongated flexible end contact. A conductive bushing preferably surrounds and contacts at least part of the whip antenna.

Preferably, a conductive clip is provided having spring contacts. In a preferred antenna assembly, the conductive clip at least partially mechanically secures the end contact of the flex antenna to the bushing (for example, by an interference fit). The conductive clip is electrically coupled to the bushing and the flex antenna. Preferably, the end contact wraps at least partially around the bushing, while the spring contacts secure the end contact between the spring contacts and the bushing.

Turning now to the drawings, preferred embodiments of an antenna assembly and preferred methods for assembling an antenna are described. As shown in FIGS. 1–4, a preferred antenna assembly 10 includes an elongated antenna such as a whip antenna 12, a nonconductive base 14, a conductive bushing 16 for supporting and contacting the whip antenna, (preferably) an insert 18 (best seen in FIG. 3) for engaging an end 19 of the whip antenna, a flex antenna 20 (also shown in FIG. 7), an overmold 22, and a clip 24. The clip 24 maintains electrical contact and, to an extent, mechanical contact between the flex antenna 20 and the bushing 16, and it is electrically coupled to a device (such as a printed circuit board (PCB)) for processing signals received by or transmitted from the flex antenna and/or whip antenna 12.

Figure 6:
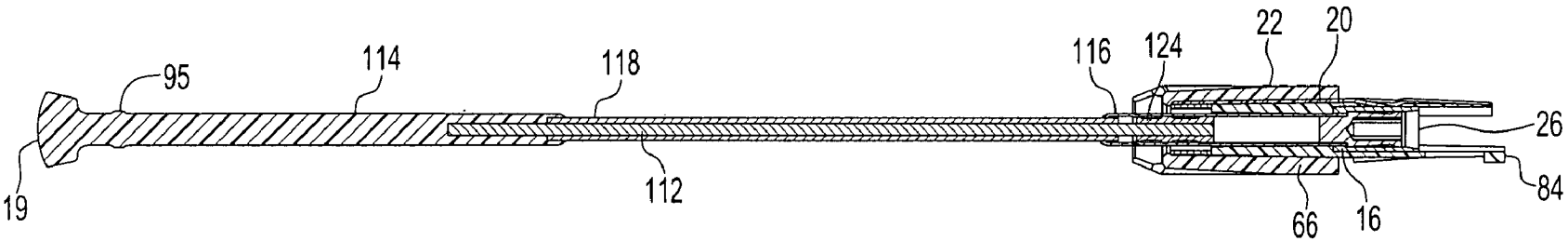
FIG. 6 is a sectional view of the antenna assembly of FIG. 5, taken along line 6—6 of FIG. 5 and in the direction indicated.

Extending the whip antenna 12 places the whip antenna into mechanical and electrical contact with the bushing 16. As shown in FIG. 6, when the whip antenna 12 of the antenna assembly 10 is extended, that is, when the end 19 is pulled away from the base 14, the bushing 16 preferably is positioned to electrically contact a stop 26 connected to the whip antenna.

The stop 26 includes a plurality of conductive, flexible spring fingers 28 that, when entering the bushing 16, deflect to retract slightly inwardly and are then biased outwardly. Surfaces 30 of the fingers maintain electrical contact with an interior of the bushing 16. Preferably, fingers 28 taper slightly along a direction from a proximal end 32 of the stop 26 until they reach a trough 34 near a distal end 36 of the stop, which has a smaller diameter than the remainder of the stop. The distal end 36 engages a lower end 38 of the bushing 16. To accommodate the distal end 36, the bushing 16 is preferably smoothly tapered outwardly along its inner surface near the lower end 38. The fingers 28 also are tapered between the trough 34 and the distal end 36 to allow a smooth fit.

Figure 7:
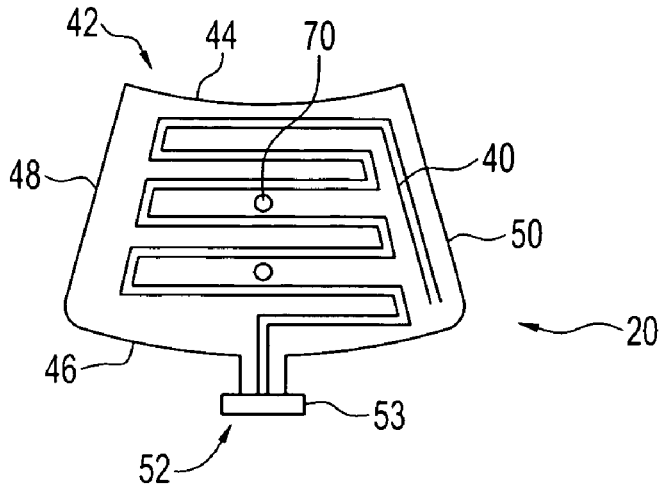
FIG. 7 is a view of a flex antenna for a preferred antenna assembly according to the present invention.

The flex antenna 20 is wrapped around at least part of the base 14 in direct or indirect contact with the base. As shown in FIG. 7, a preferred flex antenna 20 includes a conductive trace or traces 40 formed in or on a flexible substrate 42 such as a flexible, non-conductive plastic wrap. In an exemplary embodiment the substrate 42, which may be laminated with adhesive on a surface, when unfolded is shaped to resemble an outer portion of a sector of a circle, including inner and outer arcs 44, 46 connected by opposing straight edges 48, 50. This preferred design allows the substrate 42 to substantially conform to the exemplary base 14. The trace 40 terminates at a flexible, T-shaped end contact 52 that extends outwardly (as shown, downwardly) from the outer arc 46 of the substrate 42 and laterally (for example, perpendicularly) in opposing directions, forming extensions 53. The extensions 53 maintain electrical contact with the bushing 16.

Figure 8:
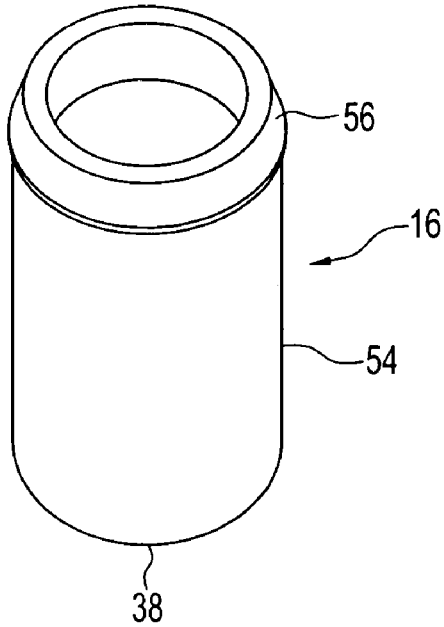
FIG. 8 is a perspective view of a bushing for an antenna assembly according to a preferred embodiment of the present invention.
Figure 9:
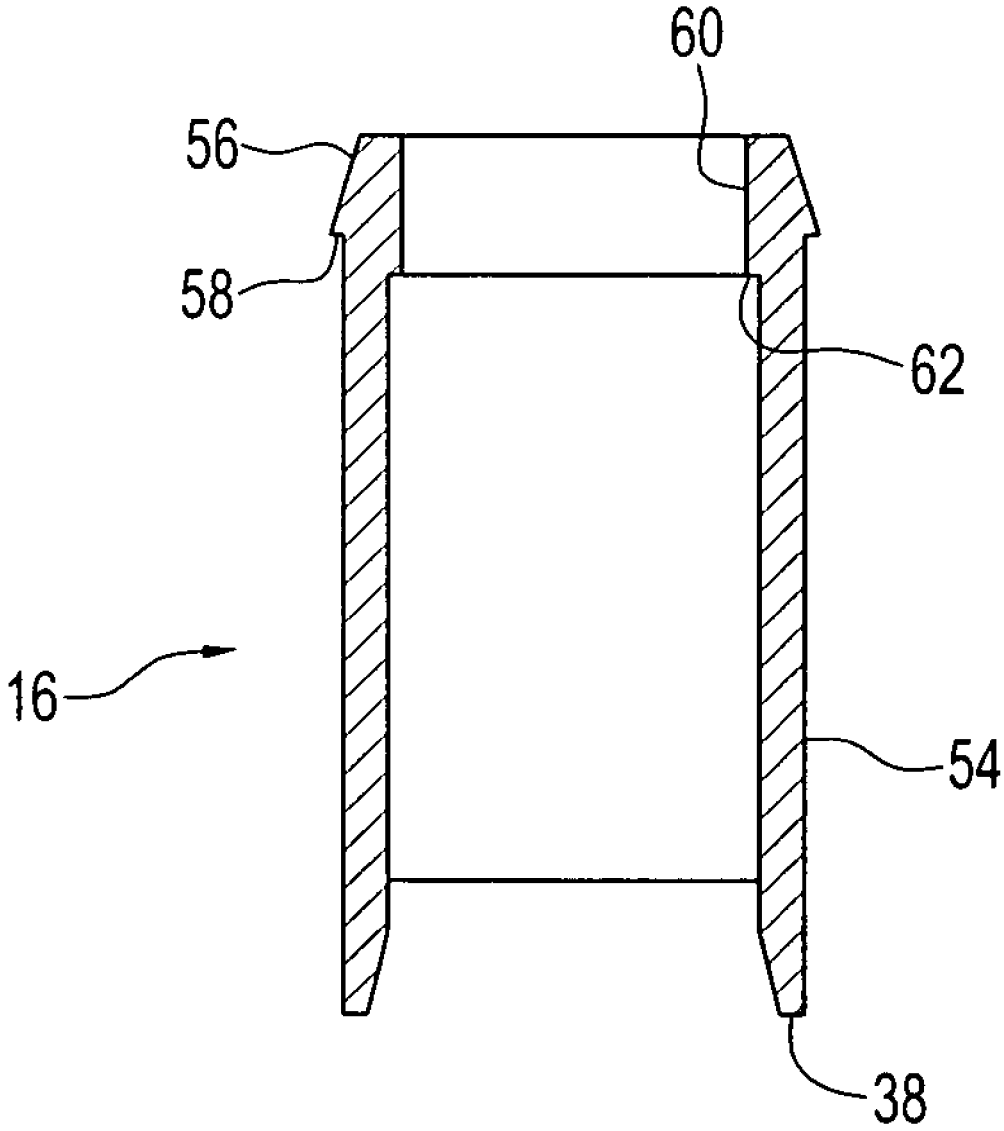
FIG. 9 is a sectional view of the bushing of FIG. 8.

Referring now to FIGS. 8–9, the bushing 16, made of a conductive, rigid material, includes a hollow cylinder 54 that terminates in the lower end 38, and at an opposing end has a chamfer 56. As more clearly shown in FIG. 9, the chamfer 56 has a larger outer diameter than that of the cylinder 54 so that an outer surface 58 of the chamfer 56 extends beyond the cylinder. This provides interference to retain the bushing within the base 14. A preferably smooth inner surface 60 of the bushing 16 within the chamfer 56 extends inwardly of the inner surface of the cylinder 54, creating a step 62 to prevent the stop 26 from being pulled past the bushing when the whip antenna 12 is fully extended.

Figure 10A:
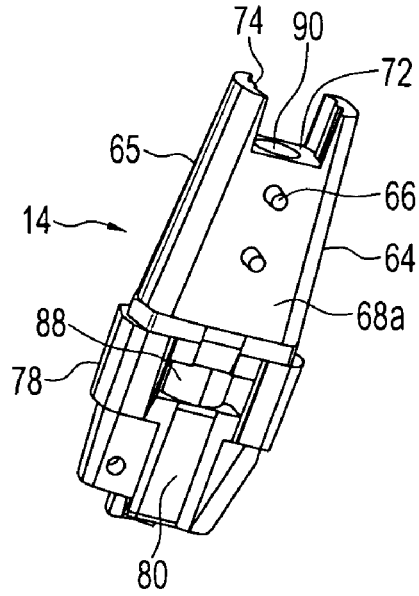
FIGS. 10A and 10B are perspective views of a base for a preferred antenna assembly according to the present invention, showing opposing sides, respectively.
Figure 10B:
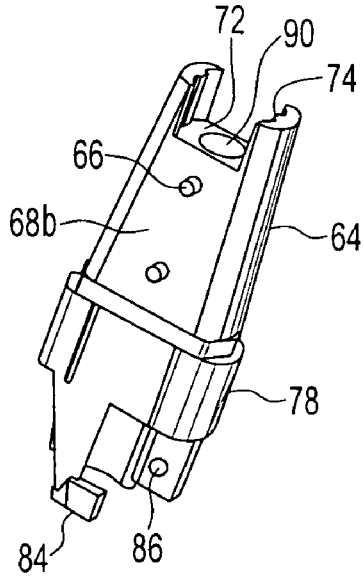
Figure 11:
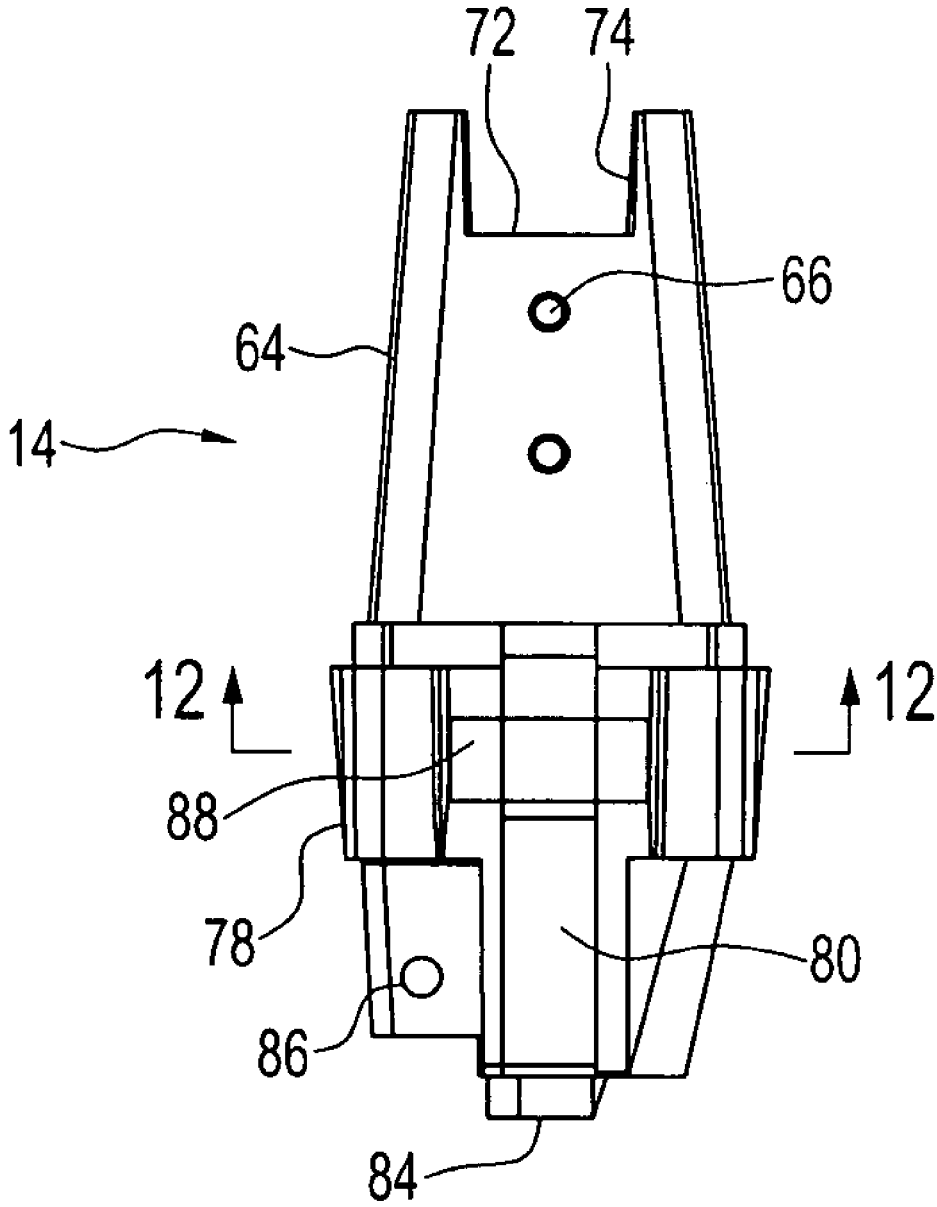
FIG. 11 is a side elevation view of the base of FIGS. 10A–10B.
Figure 13:
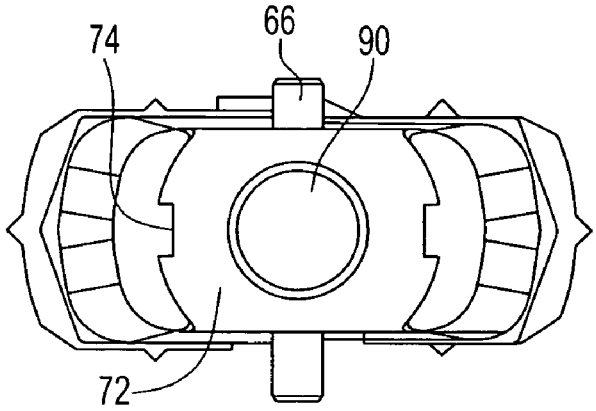
FIG. 13 is a top plan view of the base shown in FIGS. 10A–10B.
Figure 14:
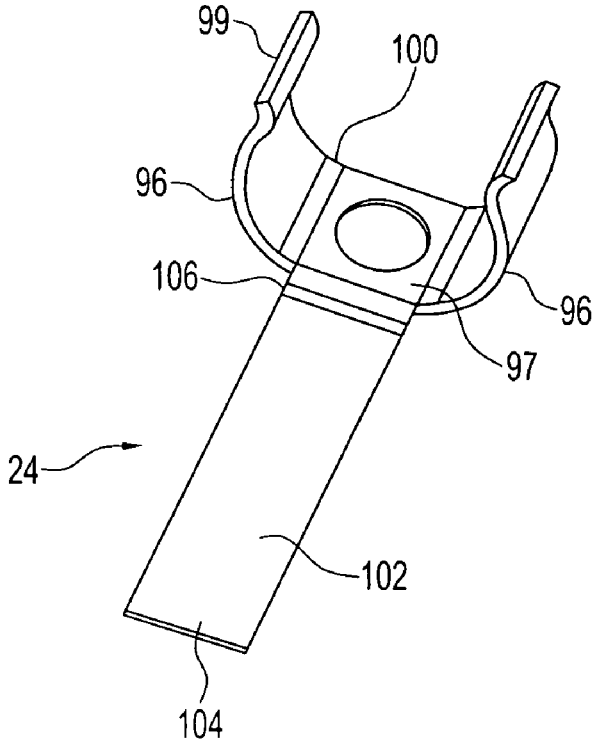
FIG. 14 is a perspective view of an antenna clip for a preferred antenna assembly according to the present invention.
Figure 15:
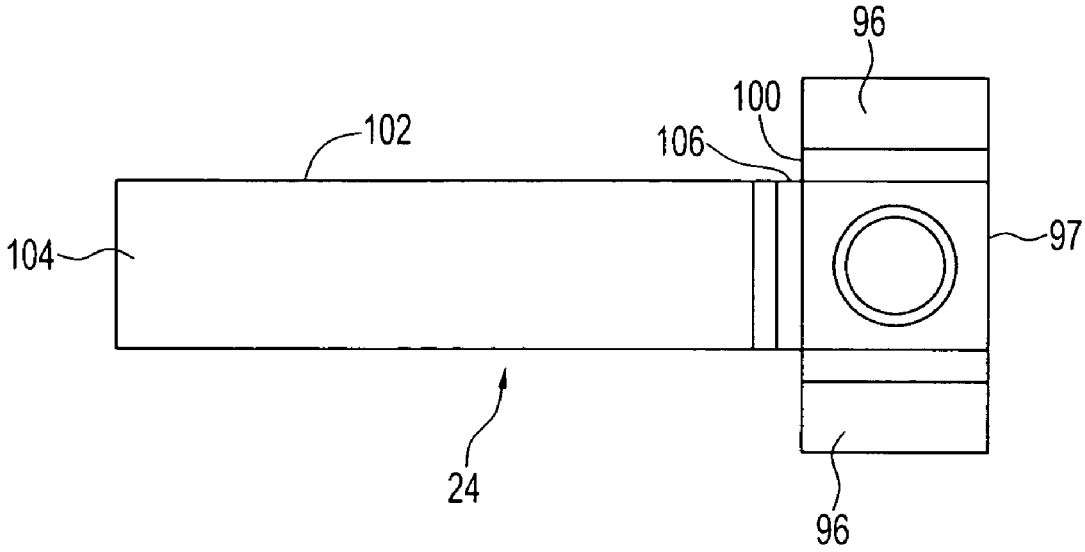
FIG. 15 is a top plan view of the antenna clip of FIG. 14.
Figure 16:
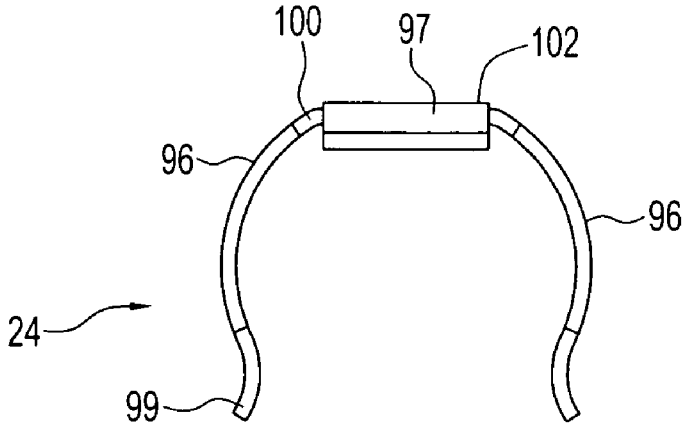
FIG. 16 is an end elevation view of the antenna clip of FIG. 14.
Figure 17:
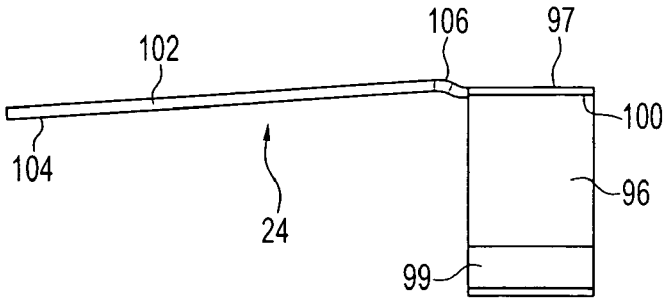
FIG. 17 is a side elevation view of the antenna clip of FIG. 14.
Figure 18:
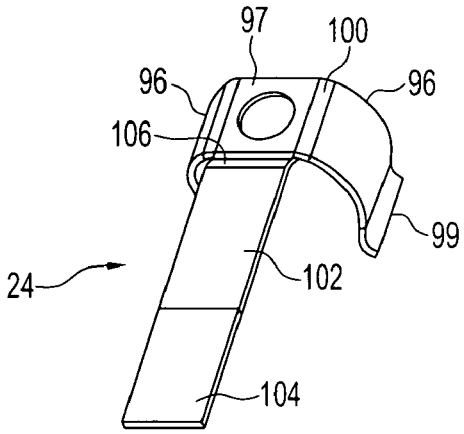
FIG. 18 is a perspective view of the antenna clip of FIG. 14, in an inverted position.

The base 14 surrounds the bushing 16 and supports the flex antenna 20, and preferably mechanically connects the antenna assembly 10 to the device. Preferably made of a nonconductive, rigid plastic material, such as LEXAN®, the base 14, as shown in FIGS. 10A and 10B, includes a tapered flex antenna support 64 at an upper end 65. The upper end 65 is the end that extends outwardly (upwardly, as shown) from the device to which the antenna assembly 10 is fitted. After a preferred final assembly, this upper end 65 is covered with the overmold 22. The flex antenna support 64 has posts 66 on opposing surfaces 68*a*, 68*b* for mating with apertures 70 of the flex antenna 20 (see FIG. 7). The surfaces 68*a*, 68*b* support the flex antenna 20, which is wrapped around the surfaces. Thus, preferably, the trace 40 of the flex antenna 20 has substantially all of its length wrapped around the upper end 65. A seat 72 (see FIG. 13) for accepting the insert 18 is defined by an opening at the top of the flex antenna support 64. The seat 72 includes inwardly-extending keys 74 that engage recesses 76 of the insert 18 to maintain a position of the insert within the seat.

Figure 12:
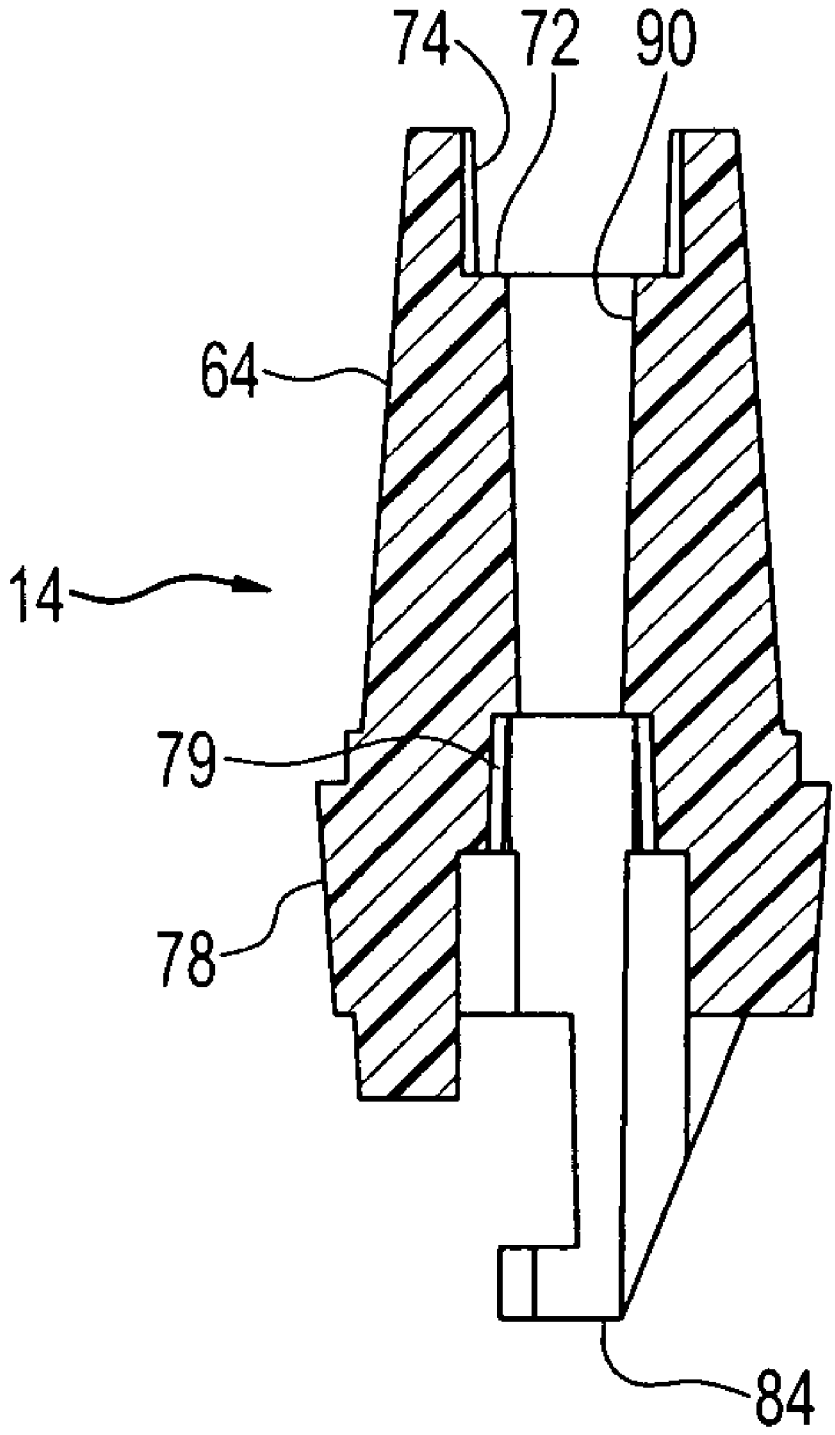
FIG. 12 is a sectional view of the base shown in FIG. 11 taken along lines 12—12 and in the direction indicated.

A lower end 78 of the base 14 supports the clip 24 and on the inside of the lower end supports the bushing 16 within a seat 79 (see FIG. 12), so that, preferably, the bushing is held within the lower end. The lower end 78 preferably is fitted inside the device. An outer groove 80 of the lower end 78 accommodates portions of the clip 24. Engaging members, such as a hook 84 and aperture 86, preferably improve connection with other parts of the device. An opening 88 exposes the bushing 16 and during assembly, accommodates insertion of the clip 24, which wraps at least partially around the bushing. A bore 90 extends axially through the base 14 to accommodate the whip antenna 12. The bore 90 is coaxial with the seat 79, so that the whip antenna 12 extends through the bore and the bushing 16.

Referring again to FIGS. 3 and 6, the insert 18 engages the whip antenna 12, and is dimensioned to fit within the seat 72. Preferably made of a plastic that is less rigid than the base 78, the insert 18 includes a bore 92 coaxial with the bore 90 of the base, so that the whip antenna 12 extends through both bores. Within an inner surface of the bore 92, protrusions 94 extend inwardly to provide a press fit with a ridge 95 at the end 19 of the whip antenna 12. The lower rigidity allows a degree of flexibility to the insert 18, so that the ridge 95 can engage the protrusions 94 when a user extends or retracts the whip antenna 12, but still substantially prevents the whip antenna from being unintentionally pulled out from the base 78.

The clip 24 maintains mechanical and electrical contact between the flex antenna 20 and the bushing 16, and electrically couples both the bushing (which in turn is electrically coupled to the whip antenna 12 when in the extended position) and the flex antenna to the device. As best seen in FIGS. 14–18, the clip 24 includes a pair of opposing spring contacts 96 for engaging the end contact 52. Extending from a center portion 97, the spring contacts 96 can be flexed away from one another to wrap around the outer surface of the bushing 16, and in this position are biased inwardly toward one another to maintain engagement with the bushing. The clip 24 is preferably made of a tempered beryllium-copper alloy, and plated with nickel.

The end contact 52 of the flex antenna 20 extends over the bushing 16. During a preferred assembly method, the spring contacts 96 are fed through the opening 88 of the base 14 to secure the end contact 52 to the bushing 16, preferably by wrapping the extensions 53 around part of the outer surface of the bushing. In this way, the clip 24 engages the bushing 16 and presses the end contact 52 against the bushing 16.

Rounded contacts 99 extend inwardly from ends of the opposing spring contacts 96. The rounded contacts 99 are preferably gold-plated for improved electrical contact. Preferably, hinges 100 are provided to improve flexibility of the spring contacts 96.

To connect the flex antenna 20 and the whip antenna 12 with the device electrically, the clip 24 includes an exposed, preferably flexible elongated contact 102 extending from the central portion 97. The elongated contact 102 preferably has a conductive (for example, gold-plated) end 104 that electrically couples to circuitry of the device. The groove 80 at the lower end 76 of the base 14 supports the elongated contact 102. A hinge 106 formed between the center portion 97 and the elongated contact 102 provides flexibility for the elongated contact. Preferably, the elongated contact 102 declines slightly when unflexed, and thus when flexed upwardly is biased downwardly against the groove 80 to be retained against the groove. Circuitry 103 of the device (see FIG. 23) electrically couples to the elongated contact 102 for receiving signals from the whip antenna 12 and the flex antenna 20.

Referring again to FIGS. 1–6, the base overmold 22 covers the upper end 65 of the base 14 and protects the flex antenna 20 wrapped around the surfaces 68*a*, 68*b* of the base 14. The base overmold 22 preferably also provides a stop for insertion of the antenna assembly 10. The base overmold 22 has a shape generally resembling a half ellipse, but with an opening 108 to accommodate the preferably rounded end 19 of the whip antenna 12. The base overmold 22 terminates at a flat bottom end to form a step 110 that limits further entry into the device to which the antenna assembly 10 is fitted. Thus, the base overmold 22 preferably is designed to extend from the device, providing a stub. The opening 108 preferably is dimensioned to accommodate most or all of the end 19, and most preferably, with the rounded end, provides a relatively smooth (continuous) outer profile. This is useful for protecting the end of the whip antenna 12 when retracted, and provides aesthetic benefits.

Figure 19:
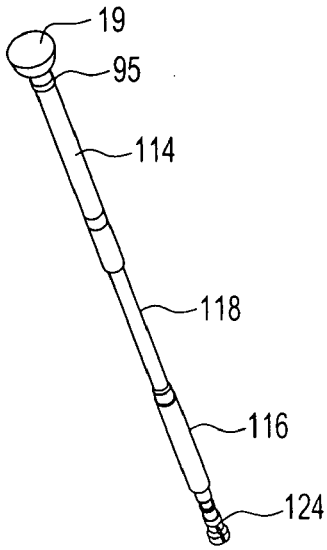
FIG. 19 is a perspective view of a whip antenna in a preferred antenna assembly according to an embodiment of the present invention.
Figure 20:
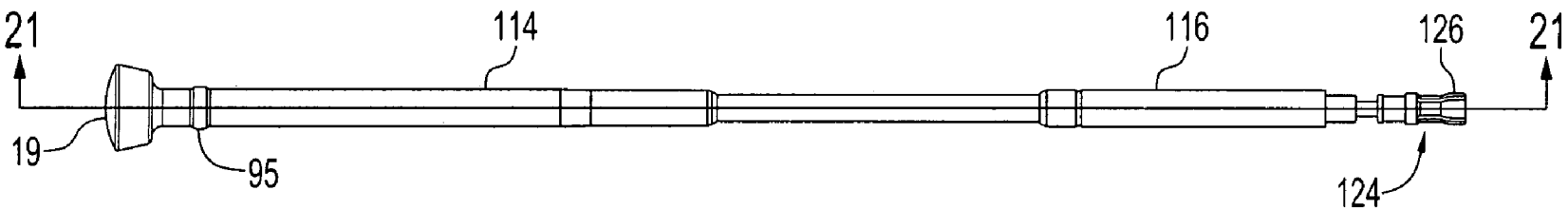
FIG. 20 is a side elevation view of the whip antenna of FIG. 19.
Figure 21:
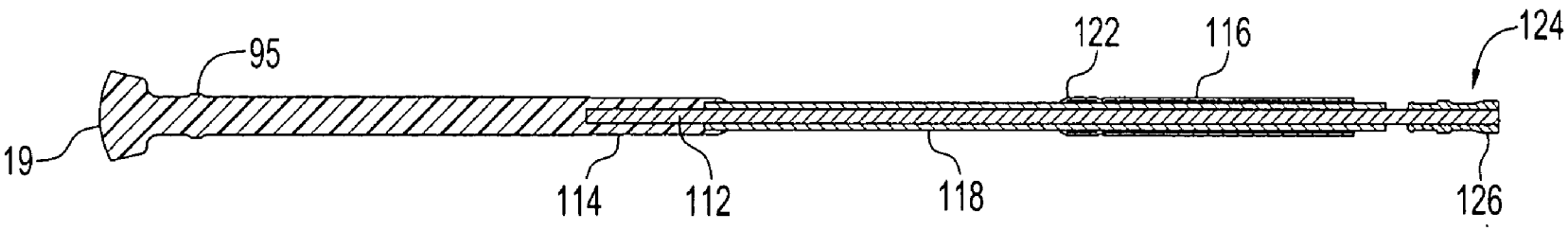
FIG. 21 is a sectional view of the whip antenna shown in FIG. 20, taken along lines 21—21 and in the direction indicated.

Referring now to FIGS. 19–21, the whip antenna 12 includes an elongated conductive wire 112, a nonconductive extension 114 including the end 19 and the ridge 95, and a slider 116 having a conductive inner surface for providing further contraction and/or expansion of the whip antenna. The conductive wire 112 is also covered by a soft, nonconductive plastic overmold 118 to protect the conductive wire. The slider 116 extends along the axial direction with respect to the conductive wire 112. The whip antenna 12 extends through the base 14. Particularly, when assembled, the conductive wire 112 and the extension 114 (except the end 19) extend through the bore 90 of the base 14. The stop 26 is connected to the slider 116 at a lower end 120 by inserting the proximal end 32 into the slider. When engaged, the stop 26 prevents the slider from moving too far along the axial direction of the conductive wire 112.

Thus, to expand the whip antenna 12, a user, for example, grabs the end 19 of the whip antenna and pulls it away from the base 14, thus extending the conductive wire 112 along an axial direction away from the base. Initially, the slider 116 moves with the conductive wire 112, until the stop 26 engages the bushing 16. Upon further extension of the whip antenna 12, the conductive wire 112 slides with respect to the slider 116 until inner spring fingers of the conductive wire 112 reach an upper end 122 of the slider, at which point it is substantially prevented from further upward (extending) movement. As previously stated, the spring fingers 28 of the stop 26 engage the lower end 38 of the bushing 16, thus providing contact between the conductive wire 112 (via the conductive slider 116) and the bushing 16.

A lower contact of the whip antenna 12 electrically contacts the bushing 16 when the whip antenna is extended relative to the base 14. Preferably, the bottom end of the whip antenna 12 includes a conductive end 124 having a plurality of outwardly biased spring fingers 126. Spring fingers 126 are formed and arranged to move along the slider 116 as the whip antenna 12 is extended. Particularly, when the whip antenna 12 is extended, the conductive wire 112, having end 124 connected at a distal end thereof, with the opposing end covered by extension 114, extends up to a point wherein the spring fingers 28 of the stop 26 engage the lower end 38 of the bushing 16.

At this point, the conductive wire 112 and end 124 (including fingers 126) slide with respect to conductive slider 116. The fingers 126, biased outwardly, engage the conductive inner surface of the slider 116. The conductive wire 112 can slide relative to the slider 116 until the spring fingers 126 of end 124 reach the upper end 122 of the slider. At this point, the whip antenna 112 is at full extension, and is prevented from further extension by engagement of the stop 26 with bushing 16. Electrical contact is present between the stop 26 and the bushing 16.

The preferred antenna assembly 10 is advantageous for mass production or repeatable production purposes. A preferred method of assembling the antenna assembly 10, beginning with the whip antenna 12, base 14, bushing 16, insert 18, flex antenna 20, clip 24, and stop 26, is as follows. The base 14 is formed. The bushing 16 is placed within the bore 90 of base 14, and the insert 18 is placed within the seat 72 of the base 14. The flex antenna 20 is wrapped around the surfaces 68*a*, 68*b* of the upper end 65 of the base 14. The posts 66 of the base 65 engage the apertures 70 of the flex antenna 20 to help hold the flex antenna in place. The end contact 52, including extensions 53, extends downwardly from the remainder of the flex antenna 20.

The overmold 22 is formed onto the upper end 65 of the base 14. The overmold 22 may be formed in any suitable manner. The clip 24 is placed within the opening 88 of base 14, and seated in a position so that the elongated contact 112 is aligned with and seated within the groove 80. The spring contacts 96 engage and flex the extensions 53 of the T-shaped contact 52 to wrap the extensions around the outer surface of the bushing 16. The whip antenna 12 (without stop 26) is threaded through the bore 92 of the insert, the bore 90 of the base 14, and the bushing 16, starting with the end opposite to end 19, so that the whip antenna is now contained partially within the base.

The stop 26 is connected to the lower end of slider 116 by inserting proximal end 32 of the stop within the slider. Preferably, the antenna assembly 10 is then assembled, and can be fitted into a portable device.

Figure 22:
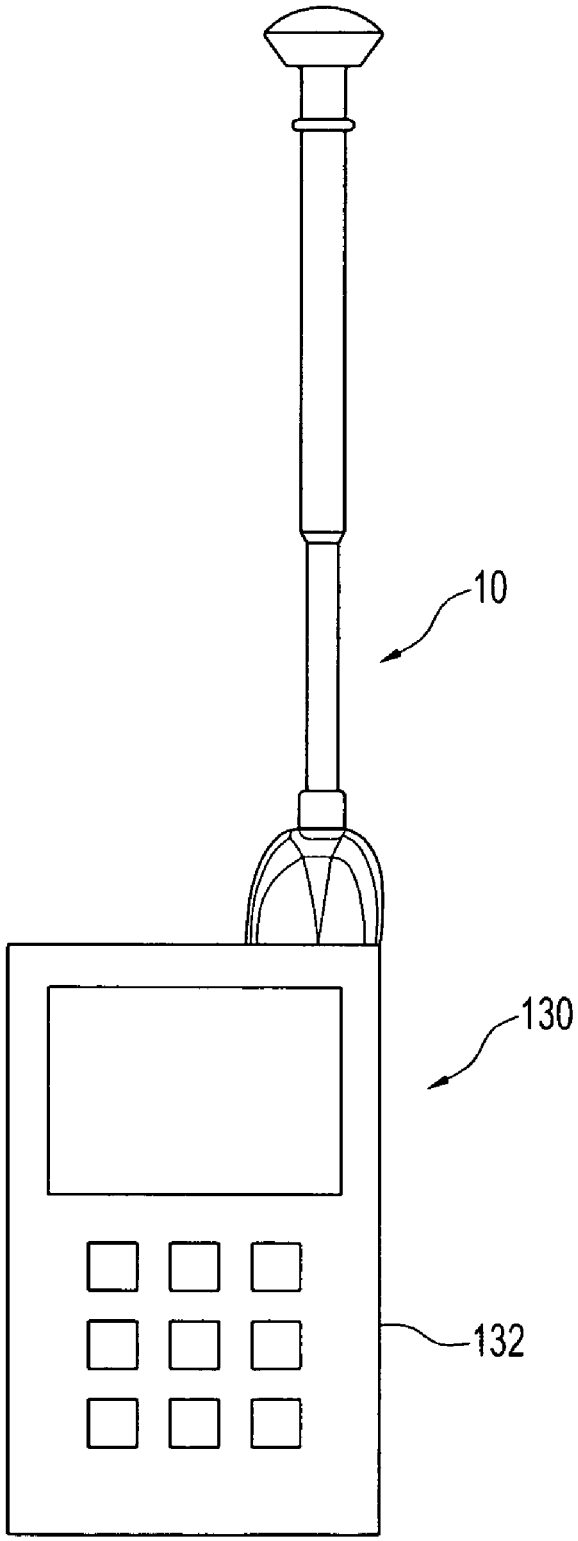
FIG. 22 is a perspective view of a portable electronic device having an antenna assembly according to a preferred embodiment of the present invention.
Figure 23:
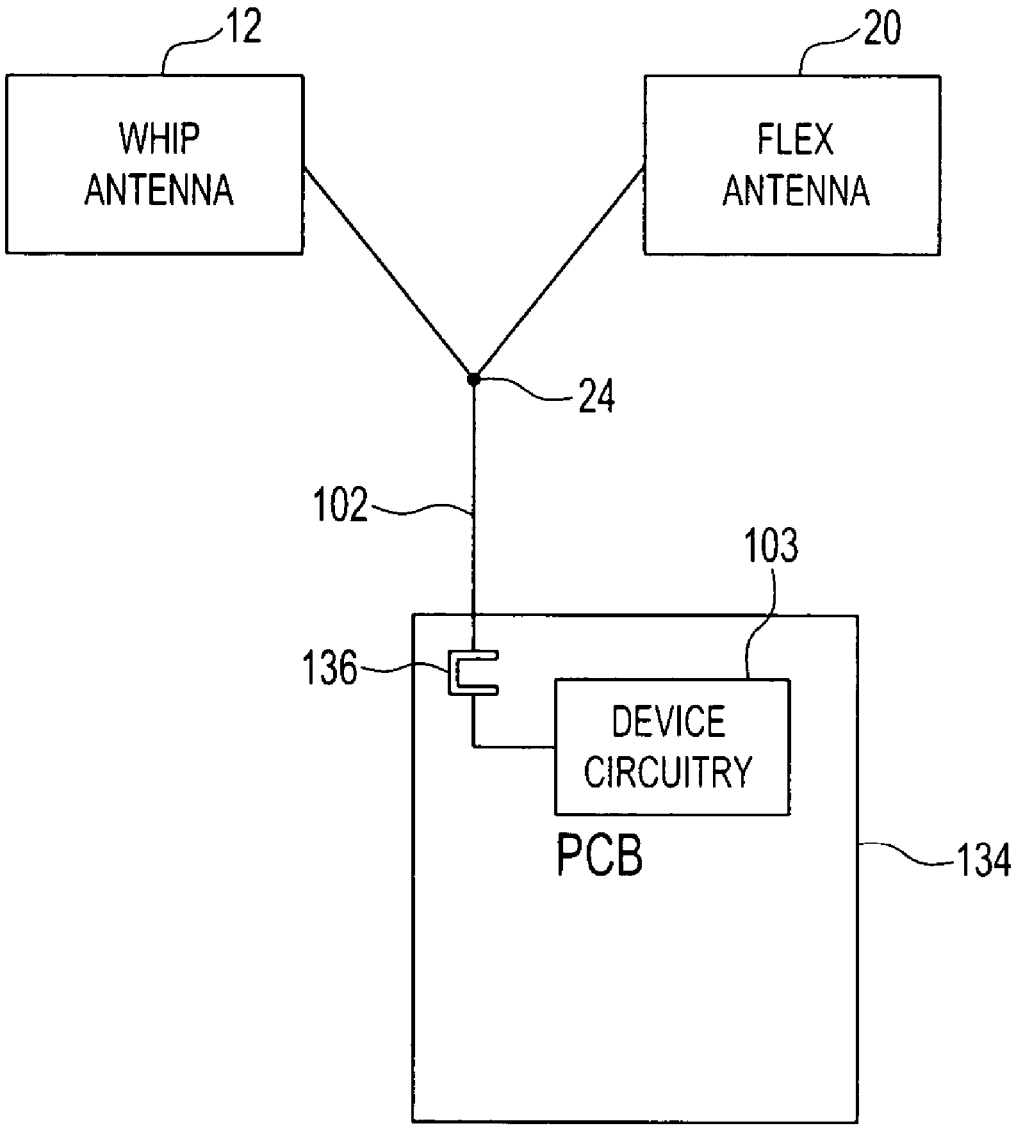
FIG. 23 is a block diagram of a preferred mobile electronic device having a preferred antenna assembly according to the present invention.

For example, FIG. 22 shows a non-limiting example of a portable communication device 130 fitted with the preferred antenna assembly 10. The hook 84 and/or aperture 86 engages a portion of a casing 132 of the device 130 to retain the base 14, and thus the antenna assembly 10, within the device. For example, the base 14 may be retained via an interference fit. As explained previously, the stop 26 substantially prevents the whip antenna 12 from disengaging with the remainder of the antenna assembly 10. The elongated contact 102 of the clip 24 electrically connects to a suitable galvanic contact of the device 130 for processing the signals from the whip antenna and flex antenna 20. For example, as shown in FIG. 23, the device 130 may include a printed circuit board (PCB) 134 having a clip 136 that engages the elongated contact 102. The clip 136 can vary from that shown in FIG. 23, and may mechanically connect with the elongated contact 102 via an interference fit, for example. The device circuitry 103 processes the signals received. The device circuitry 103 may be, for example, circuitry suitable for a mobile phone or other communication device or other portable device.

Those in the art will appreciate that an inventive antenna assembly 10 and assembly method has been provided which has many unique features and advantages. The preferred antenna assembly 10 allows both a flex antenna 20 as well as an elongated antenna such as whip antenna 12 for reception of different frequencies for use by a particular portable device. The clip 24 provides electrical connection between the flex antenna 20, the whip antenna 12, and the printed circuit board 134 of the device 130, while allowing a relatively sturdy mechanical connection. Additionally, the antenna assembly 10 and assembly method provides a production facility with the ability to integrate the assembly method into a repeatable or mass production, while maintaining reliability.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various embodiments of the present invention are set forth in the appended claims.

What is claimed is:

1. An antenna assembly for a portable device comprising:

a nonconductive base;

a conductive bushing held within a lower end of said base;

a flex antenna wrapped around said base, said flex antenna including a trace having substantially all of its length disposed around an upper end of said base axially away from said conductive bushing and terminating in a flexible end contact that extends over said bushing;

a conductive mechanism engaging said conductive bushing and pressing said flexible end contact against said bushing, said conductive mechanism having an exposed elongated contact; and a whip antenna extending through said nonconductive base, said whip antenna including a nonconductive extension extending from a top end thereof and a lower contact for electrically contacting said bushing when said whip antenna is extended relative to said base.

2. The antenna assembly of claim 1 wherein said conductive mechanism comprises a conductive clip including spring contacts engaging said conductive bushing.

3. The antenna assembly of claim 2 wherein the spring contacts mechanically secure the flexible end contact to said conductive bushing.

4. The antenna assembly of claim 3 wherein the spring contacts extend at least partially within an opening of the lower end of said base.

5. The antenna assembly of claim 2 wherein the spring contacts and the elongated contact are at least partially coated with a conductive material.

6. The antenna assembly of claim 5 wherein the conductive material comprises gold.

7. The antenna assembly of claim 1 wherein said conductive bushing engages conductive spring fingers coupled to said whip antenna.

8. The antenna assembly of claim 7 wherein said conductive bushing includes a portion that substantially prevents travel of the spring fingers completely through said conductive bushing, wherein when said whip antenna is extended, the spring fingers engage said conductive bushing to substantially prevent removal of said whip antenna from the portable device.

9. The antenna assembly of claim 1 wherein said flexible antenna comprises a flexible substrate at least partially wrapped around the upper end of said base, wherein the conductive trace, except for the end contact, is disposed on the substrate.

10. The antenna assembly of claim 1 further comprising:

an overmold substantially covering the upper end of said base.

11. The antenna assembly of claim 1 further comprising:

an insert disposed at least partially within the upper end of said base, said insert including a bore through which said whip antenna extends, the bore including at least one protrusion for engaging a ridge on said extension to provide resistance to extending said whip antenna after said whip antenna is fully retracted.

12. The antenna assembly of claim 11 wherein said base is made of a rigid plastic, and wherein said insert is made of a material less rigid than the rigid plastic.

13. An antenna assembly for a portable device comprising:

a nonconductive base;

a conductive bushing held within a lower end of said base;

a flex antenna wrapped around said base, said flex antenna including a trace having substantially all of its length disposed around an upper end of said base axially away from said conductive bushing and terminating in a flexible end contact that extends over said bushing;

a whip antenna extending through said nonconductive base, said whip antenna including a nonconductive extension extending from a top end thereof and a lower contact; and means for electrically connecting said trace and said bushing to an exposed contact and for electrically connecting said whip to said exposed contact through said bushing when said whip antenna is extended relative to said base.

14. The antenna assembly of claim 13 wherein said conductive bushing engages conductive spring fingers coupled to said whip antenna.

15. The antenna assembly of claim 14 wherein said conductive bushing includes a portion that substantially prevents travel of the spring fingers completely through said conductive bushing, wherein when said whip antenna is extended, the spring fingers engage said conductive bushing to substantially prevent removal of said whip antenna from the portable device.

16. The antenna assembly of claim 13 wherein said flexible antenna comprises a flexible substrate at least partially wrapped around the upper end of said base, wherein the conductive trace, except for the end contact, is disposed on the substrate.

17. The antenna assembly of claim 13 further comprising:

an overmold substantially covering the upper end of said base.

18. The antenna assembly of claim 13 further comprising:

an insert disposed at least partially within the upper end of said base, said insert including a bore through which said whip antenna extends, the bore including at least one protrusion for engaging a ridge on said extension to provide resistance to extending said whip antenna after said whip antenna is fully retracted.

19. The antenna assembly of claim 18 wherein said base is made of a rigid plastic, and wherein said insert is made of a material less rigid than the rigid plastic.

20. A portable communication device comprising:

a nonconductive base;

a conductive bushing held within a lower end of said base;

a flex antenna wrapped around said base, said flex antenna including a trace having substantially all of its length disposed around an upper end of said base axially away from said conductive bushing and terminating in a flexible end contact that extends over said bushing;

a conductive mechanism engaging said conductive bushing and pressing said flexible end contact against said bushing, said conductive mechanism having an exposed elongated contact; and a whip antenna extending through said nonconductive base, said whip antenna including a nonconductive extension extending from a top end thereof and a lower contact for electrically contacting said bushing when said whip antenna is extended relative to said base; and circuitry coupled to the elongated contact for processing signals from said elongated antenna and said flex antenna.

* * * * *